US005415151A

United States Patent [19]

Fusi et al.

[11] Patent Number: 5,415,151

[45] Date of Patent: May 16, 1995

[54] PHOSPHOR-CONTAINING PROJECTILE AND LAUNCHER THEREFOR

[75] Inventors: John C. Fusi, New Providence; Eric H. Gale, High Bridge, both of N.J.

[73] Assignee: JCF Research Associates, Inc., New Providence, N.J.

[21] Appl. No.: 124,395

[22] Filed: Sep. 20, 1993

[51] Int. Cl.[6] ..... F41B 11/00; F41B 7/08

[52] U.S. Cl. ..... 124/56; 124/1; 124/16; 124/83; 273/428; 273/DIG. 24; 446/219

[58] Field of Search ..... 273/424, 425, 428, DIG. 24; 446/219; 124/56, 16, 21, 22, 26, 27, 80, 83, 1

[56] References Cited

U.S. PATENT DOCUMENTS

| | | | |
|---|---|---|---|
| 2,236,390 | 3/1941 | Wood et al. . | |
| 2,629,516 | 2/1953 | Badham . | |
| 3,240,924 | 3/1966 | Darby . | |
| 3,902,722 | 9/1975 | Skillern | 273/DIG. 24 X |
| 3,980,300 | 9/1976 | Hornsby | 446/219 X |
| 4,086,723 | 5/1978 | Strawick | 446/219 X |
| 4,175,353 | 11/1979 | Pickett . | |
| 4,239,129 | 12/1980 | Esposito | 222/79 |
| 4,552,365 | 11/1985 | Smith | 273/DIG. 24 X |
| 4,572,803 | 2/1986 | Yamazoe et al. | 534/16 |
| 4,735,239 | 4/1988 | Salmon et al. . | |
| 4,750,641 | 6/1988 | Chin-Fu | 222/79 |
| 4,927,015 | 5/1990 | Jones | 273/DIG. 24 X |
| 4,930,776 | 6/1990 | Newcomb et al. | 446/219 X |
| 4,989,881 | 2/1991 | Gamble | 273/416 |
| 5,080,359 | 1/1992 | Thill | 446/219 X |
| 5,228,697 | 7/1993 | Gulick et al. | 273/DIG. 24 X |
| 5,308,546 | 5/1994 | Hansen et al. | 446/219 X |

FOREIGN PATENT DOCUMENTS

| | | | |
|---|---|---|---|
| 1116470 | 5/1956 | France | 446/219 |

*Primary Examiner*—Eric K. Nicholson
*Assistant Examiner*—John A. Ricci
*Attorney, Agent, or Firm*—Amster, Rothstein & Ebenstein

[57] ABSTRACT

The present invention encompasses a toy launcher, a phoshor-containing projectile and, in combination, a toy launcher and a phosphor-containing projectile. The launcher includes a mechanism for launching the phosphor-containing projectile outwardly from the launcher, and a radiation-emitter for exposing the projectile within the launcher to phosphorescence-activating radiation prior to the projectile leaving the launcher, whereby the projectile will phosphoresce as it leaves the launcher.

26 Claims, 3 Drawing Sheets

PHOSPHOR-CONTAINING PROJECTILE AND LAUNCHER THEREFOR

BACKGROUND OF THE INVENTION

The present invention relates to a phospor containing projectile, a toy launcher therefor, and a combination thereof, and more particularly to such a combination wherein the projectile will phosphoresce as it leaves the launcher.

The appeal to children and adults alike of an illuminated or glowing object traveling across a dark background (like a shooting star against the night) is well recognized by those in the toy art. Accordingly, a water gun sold under the trade name LUMINATOR utilizes a two-part chemiluminescent system wherein the two fluids are mixed by the gun just prior to ejection. A strong blue glow emanates from the resulting fluid mix, illuminating both the stream of fluid in the air and the target once the target is struck and thus wet by the fluid. Further, the TCR (TOTAL CONTROL RACING) line of the Ideal Toy Corporation included a road racing set with phosphorescent cars which intermittently pass through a black-light tunnel, thereby causing them to glow when they exited from the tunnel. Indeed, U.S. Pat. Nos. 2,629,516 and 4,239,129 disclose otherwise conventional water guns including a light source which emits a light beam to illuminate the stream of water issuing from the barrel. However, once the stream of water and the beam of light diverge, the liquid stream is no longer illuminated.

Thus, none of the known devices enable a phosphorescent projectile to be launched from a launcher (e.g., a gun, cannon or other stylized delivery system) which renders the projectile brightly visible in flight (preferably from the instant of launch from the launcher and preferably for some time after the projectile flight is terminated), thus allowing for outdoor play at night and/or indoor play in darkened spaces. It is especially desirable that the projectile, when reusable, continue to phosphoresce even after it has terminated its flight so that it is easy to locate for reuse.

Accordingly, it is an object of the present invention to provide a system which enables phosphorescent projectiles to be launched from a gun or other delivery system which renders the projectile brightly visible in flight and/or during game play, thus allowing for outdoor play at night and/or normal play in dark spaces.

Another object to provide such a system wherein the projectile is phosphorescent from the instant of launch from the launcher and preferably for some time after the projectile flight is terminated.

A further object is to provide such a system wherein in one embodiment the projectile is non-rigid or flexible.

Another object is to provide such a system wherein in one embodiment the projectiles contain text or other stylized designs which are rendered phosphorescent either positively or negatively.

A further object is to provide such a system wherein in one embodiment the projectile includes a phosphorescent gel or fluid.

It is an object of the present invention to provide such a system which is safe for use by children.

SUMMARY OF THE INVENTION

It has now been found that the above and related objects of the present invention are obtained in a combination of a toy launcher and a phosphor-containing projectile.

In the combination, the launcher comprises means for launching the phosphor-containing projectile outwardly from the launcher, and means for exposing the projectile within the launcher to phosphorescence-activating radiation prior to the projectile leaving the launcher whereby the projectile will phosphoresce as it leaves the launcher.

The phosphor-containing projectile for launching from a toy launcher in a phosphorescent state after exposure to phosphorescence-activating radiation by the launcher has several embodiments. In a first embodiment, the projectile comprises a plastic core (typically non-transparent) and a phosphor-containing surface coating. Preferably the core is non-rigid (e.g., foamed plastic), and the surface coating is flexible. In a second embodiment, the projectile consists of a phosphor-containing, preferably otherwise clear plastic.

In a third embodiment, the projectile comprises an opaque core, and a design-defining pattern of a phosphor-containing surface coating. In a fourth embodiment, the projectile comprises a phosphor-containing otherwise clear core, and a design-defining pattern of an opaque surface coating. In either the third or fourth embodiment, the projectile may comprise a core containing a first phosphor, and a design-defining pattern of a surface coating containing a second phosphor. The first and second phosphors have phosphorescence of different colors such that the phosphorescence color of one phosphor is visible against the phosphorescence color of the other phosphor.

In a fifth embodiment, the projectile comprises a phosphor-containing material selected from the group consisting of fluids, gels, and combinations thereof and is preferably in the form of a fluid-containing gel capsule. In a sixth embodiment, the projectile comprises a phosphor-containing helicopter disk.

The toy launcher for a phosphor-containing projectile, comprises means for launching a phosphor-containing projectile outwardly from the launcher, and means for exposing the projectile within the launcher to phosphorescence-activating radiation prior to the projectile leaving the launcher, whereby the projectile will phosphoresce as it leaves the launcher.

In a preferred embodiment of the launcher, the exposing means exposes the projectile to radiation of near UV to visible wavelengths, thereby to cause the projectile to phosphoresce. The launcher may additionally include a breech and a barrel or bore, the launching means launching the projectile in the breech through the barrel or bore, and the exposing means being disposed in the breech and exposing the projectile in the breech to the radiation. Alternatively or additionally, the exposing means is disposed in the barrel or bore and exposes the projectile to the radiation- as the projectile passes through the barrel or bore.

Manually operable means are provided for actuating the exposing means.

Preferably the manually operable means actuate the launching means and the exposing means in timed relationship—e.g., either simultaneously or the exposing means prior to the launching means. The launcher may additionally include a magazine configured and dimensioned to hold a plurality of projectiles, and means to feed the projectiles serially to the launching means, the actuating means actuating the feed means and the exposing means. The launcher may additionally include manually actuatable means for cocking the launching means, the cocking means also actuating the exposing means. Preferably, the exposing means exposes the projectile to the radiation only briefly, and only immediately prior to the projectile leaving the launcher.

In a preferred embodiment of the combination, a mask means is disposed intermediate the exposing means and the projectile such that the mask means enables passage of the phosphorescent-activating radiation from the exposing means to the projectile only in a design-defining pattern, whereby only portions of the projectile are exposed to the phosphorescence-activating radiation prior to the projectile leaving the launcher, and the projectile will phosphoresce as it leaves the launcher in a design determined by the mask means.

The combination may include a plurality of the mask means, only one of the mask means at a time being disposed intermediate the exposing means and the projectile. Preferably the plurality of mask means are disposed on a cylinder, and the cylinder is rotatable to dispose at a given time a selected one of the plurality of mask means intermediate the exposing means and the projectile. The projectile has, on at least an outer surface of at least a sector thereof, a uniform phosphor level, and the exposing means exposes the outer surface of the sector of the projectile selectively through the mask means to the phosphorescence-activating radiation. The mask means is optionally removable from the remainder of the launcher.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
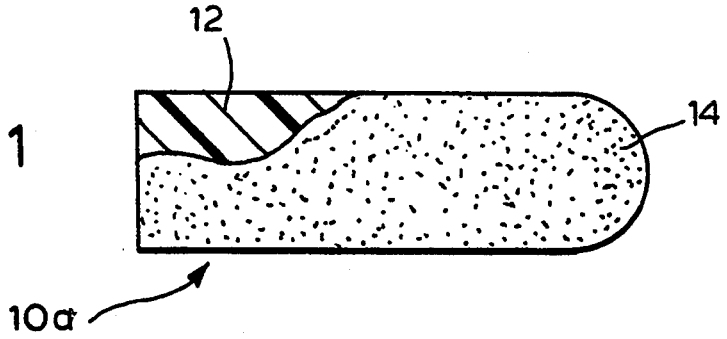
FIGS. 1–5 are side elevational views of the first through fifth embodiments, respectively, of a phosphor-containing projectile according to the present invention.

The phosphor-containing projectile according to the present invention is generally designated by the reference numeral 10. While the projectile 10 of FIGS. 1–5 is illustrated as being in the form of a toy bullet of a particular configuration and dimensions, clearly the projectile may be formed like a bullet of different configurations and/or dimensions, or like any of the other projectiles which may be launched such as cannon shells, arrows, planes, helicopter-disks, game pieces, and the like. Indeed, the projectile may be a transparent or translucent, round softgel capsule containing a phosphor-containing fluid within the capsule so that the projectile is visible in flight and leaves a luminous mark on any target which the projectile strikes, or even a phosphor-containing helicopter disk.

Depending upon the particular application intended for the projectile, the projectile 10 may come in a variety of different embodiments.

Referring now to the drawing, and in particular to FIG. 1 thereof, in a first embodiment the non-rigid projectile **10*a* is formed of a plastic core 12 having a phosphor-containing coating 14 uniformly disposed on the outer surface thereof. The core 12 is typically, but not necessarily, non-transparent (i.e., opaque or translucent). For safety reasons, the core 12 may be formed of a non-rigid material (preferably a foamed plastic), and the surface coating may be formed of a flexible material (preferably a plastic such as polyurethane), so that the projectile is non-rigid and preferably resilient. As phosphors are relatively expensive, the first embodiment disposes all the phosphors in the surface coating 14 where they best contribute to the luminosity of the projectile. On the other hand, as only the surface coating 14 of the projectile is contributing to the luminosity thereof, a relatively high loading thereof with the phosphor must be used. Thus phosphor loadings of the surface coating 14** are about 1–50% by weight, preferably 5–25%.

Figure 2:
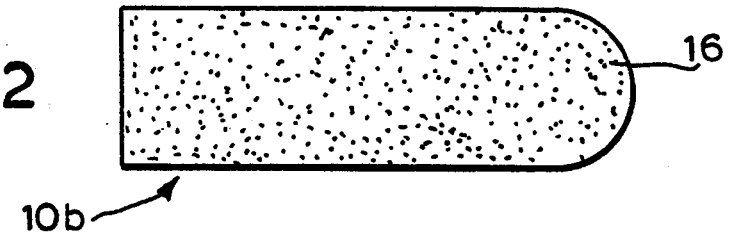

Referring now to FIG. 2, in a second embodiment the uncoated projectile **10*b* is formed of a plastic 16** containing the phosphor uniformly dispersed therein. Preferred plastics (without the phosphor) are rigid and generally transparent, and may include clear polyvinyl chloride (PVC), the clear copolymers of styrene/butadine available under the trade name K-RESIN (from Phillips 66 Company), clarified polypropylene, and the like. Because the clear plastics permit efficient activation of the phosphor located throughout the plastic (rather than only at the surface thereof), a relatively low level of phosphor loading is effective. Thus, the phosphor loading is about 1–20% by weight, preferably 5–10%.

It will be appreciated by those skilled in the art that the high phosphor loading level required for effective phosphorescence typically renders non-transparent any originally clear or transparent material upon loading with the phosphor. Accordingly, references herein to a clear or clarified material containing a phosphor should be interpreted as a clear or clarified material (absent the phosphor) having a phosphor added thereto.

It will also be appreciated that the lower loading level (e.g., 1–20% by weight) discussed in connection with the second embodiment is based on the total weight of the projectile, including the plastic and the phosphor, whereas the higher loading level (e.g., 1–50% by weight) discussed in connection with the first embodiment is based on the weight of the surface coating alone (including the phosphor), so that the difference in the quantity of phosphor required is not as great as it might appear upon first consideration. The first embodiment is typically cheaper than the second embodiment, but the second embodiment typically has greater functional longevity.

Typically, the plastic used in the second embodiment is non-foamed, as conventional foamed plastics are not transparent. However it will be appreciated by those skilled in the art that the projectile 10b of the second embodiment may also be formed of a non-transparent material such as the opaque plastics, such as polyethylene, acrylonitrile-butadiene-styrene, and high impact polystyrene (HIPS). Such an opaque plastic matrix requires either the use of a higher loading of phosphor to compensate for the lack of transparency or the acceptance of a lower intensity of phosphorescence.

While the first and second embodiments **10*a* and 10*b*** of the projectile described above are suitable for most uses, two additional embodiments are directed to specialty applications where the projectile is to present a special logo, design or pattern to the viewer during flight. The logo may represent a trademark or other identifying indicia, but may equally be an abstract pattern appropriate to the particular application.

Figure 3:
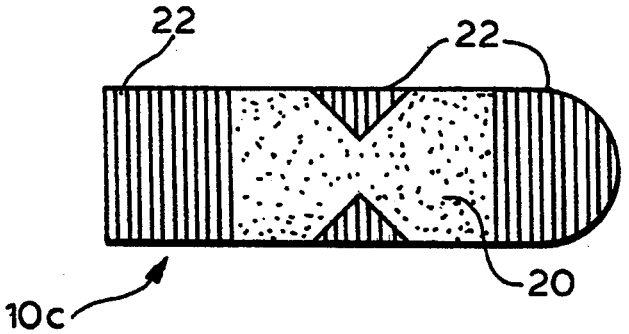

Referring now to FIG. 3, in the third embodiment the patterned projectile **10*c* is formed of a generally transparent material containing phosphor as the core 20 (typically with a 1–20%, preferably 5–10%, phosphor loading factor) and a logo-defining pattern 22 of an opaque surface coating thereon. Alternatively, the core 20 may be formed of a phosphor-free material having a phosphor-containing outer surface coating disposed under at least the logo portion 22 of projectile 10*c***.

Figure 4:
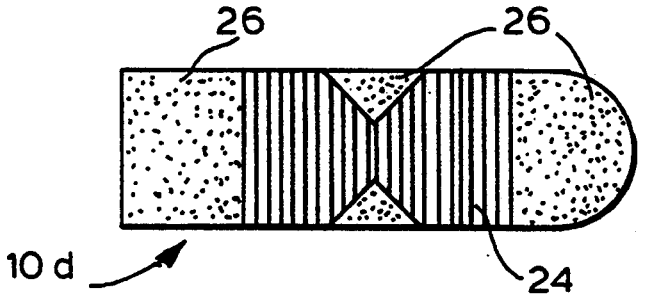

Referring now to FIG. 4, in the fourth embodiment the patterned projectile **10*d* is formed of an opaque core 24 having a logo-defining pattern 26** of phosphor-containing surface coating thereon (typically with a 1–50%, preferably 5–25%, phosphor loading factor).

The pattern of surface coating 22, 26 may define the logo either positively (that is, the surface coating may be in the form of the logo) or negatively (that is, the surface coating may define a background which is characterized by the absence of the logo).

It will be appreciated by those skilled in the visual advertising arts that a wide variety of different effects may be obtained by selecting the projectiles from the third or fourth embodiments and appropriately selecting either a positive or negative image of the logo. Thus the selected third or fourth embodiment may result in a projectile with a bright, luminous logo on an otherwise dark background or, alternatively, a dark dropout-type logo on an otherwise bright, luminous background.

A projectile with a bright luminous logo on an otherwise dark background may be obtained if a positive logo is formed in the fourth embodiment with the phosphor-containing surface coating or a negative logo is formed in the third embodiment by the opaque surface coating, thereby to enable the luminosity of the core to be visible as the logo and to block the luminosity of the core elsewhere. A projectile with a dark dropout-type logo on an otherwise bright luminous background may be obtained if a positive logo is formed in the third embodiment by an opaque surface coating or a negative logo is formed in the fourth embodiment by the phosphor-containing surface coating.

The term "opaque" as used in the specification and the claims refers to a core or coating material which provides a background for the phosphorescent material of the coating or core, respectively. Thus the "opaque" material may either be non-phosphorescent or phosphorescent if the color of its phosphorescence differs sufficiently from the color of the other phosphorescence so that it forms a suitable contrasting background therefor. While generally the opaque material will be phosphor-free as described above, where particular effects involving phosphorescence in two different colors is desired, both the core and the coating may be phosphorescent, but with suitably different colors. Thus, in the third or fourth embodiments the projectile may have a bright, luminous logo of one color on a contrasting luminous background or, alternatively, a dark, luminous dropout-type logo of one color on a contrasting luminous background.

Figure 5:
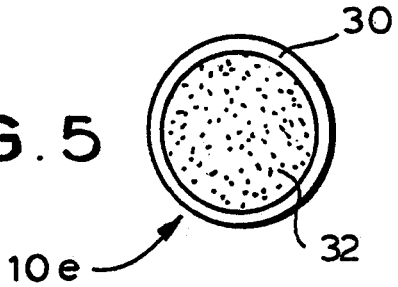

Referring now to FIG. 5, in a fifth embodiment the projectile **10*e* may be a shell-shaped, cylindrical or round softgel capsule 30 (such as those currently available in non-luminous form from Banner Gelatin Products of Chatsworth, Calif.) formed of a phosphor-free, generally transparent material. These capsules 30 encapsulate a phosphor-containing fluid 32 (generally at a 1–50%, preferably 5–25%, phosphor loading factor). The fluid is preferably thixotropic, for better suspension of the phosphor in the fluid in the capsule and for better wetting of the target due to the shear effect of the projectile 10*e* striking the target. Alternatively, the fluid may be a highly viscous Newtonian fluid. This embodiment 10*e* is typically used in the $CO_2$-powered launchers of the type commonly used in "Survival Games." This embodiment provides a means to effectively play the Survival Game sport in the dark, as the luminous projectiles will be visible in flight and will leave a luminous mark on any target which the projectile may strike. Where the capsules 30 are transparent, as illustrated, they need not be made of phosphor-containing material, as the luminous fluid 32 will be visible therethrough. If desired, however, the capsules 30** may also be formed of a phosphor-containing material.

The first through fourth embodiments **10*a*–10*d* lend themselves to reusable projectiles, while the fifth embodiment 10*e*** does not.

Figure 6:
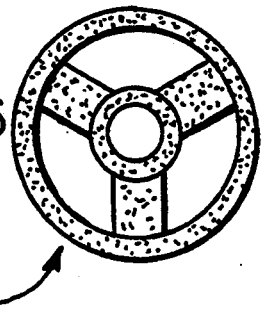
FIG. 6 is an isometric view of a sixth embodiment of a phosphor-containing projectile according to the present invention.

Referring now to FIG. 6, in a sixth embodiment 10f the projectile is a helicopter-disk made of a phosphor-containing material. A "helicopter-disk" is an annular device wherein the spokes connecting the inner and outer circular members are self-contained airfoils which provide sufficient lift for launch once the disk has been set into rotation either manually or by means of a battery-operated motor within the launcher. The phosphor may be uniformly dispersed throughout the material of which the helicopter-disk is formed or it may be concentrated in the outer periphery, the inner periphery or the airfoils, as desired for a particular application and aesthetics. The use of phosphor-containing helicopter-disks as projectiles **10*f*** provides a safe means to launch luminous, reusable, non-pyrotechnic aerial displays.

Although a wide variety of conventional phosphors may be used in the practice of the present invention, preferred phosphors are defined by the chemical formula $$(n)ZnS(1\text{-}n)CdS:(m)Cu \qquad (1)$$

where n may vary from 0.75 to 1.0, and m is of the order of 0.01%; and/or $$(n)CaS(1\text{-}n)SrS:(m)Bi,(z)Cu, \qquad (2)$$

where n may vary from 1.0 to 0, m is on the order of 0.04%, and z is on the order of 0.01%.

The preferred particulars of the two chemical formulas provided above are found in "The Pigment Handbook," Vol. 1, "Properties and Economics" (John wiley & Sons 1973), as are the appropriate caveats, including the need to avoid the presence of contaminants which might deactivate the phosphorescent activity or otherwise interfere with the production of phosphorescence.

As the phenomenon of phosphorescence relies upon photon excitation of molecules, the amount of luminosity or light produced by a phosphorescent material will depend upon the quantity of phosphorescence-exciting radiation absorbed by the material. Only a very brief exposure of the phosphor to the exciting radiation is required. One second typically suffices, and two seconds is generally more than enough to obtain maximum phosphorescence. Once exposed to the exciting radiation, the phosphor immediately begins to phosphoresce, with the phosphorescence typically continuing brightly for 30–45 seconds and less brightly for up to two minutes, depending upon the particular phosphor.

While particular phosphors will respond to exciting radiation of a given wavelength, generally radiation in the near-ultraviolet to visible is appropriate. The use of a near-UV excitation source enables the radiation used to be invisible to human vision so that only the tracer-effect of the projectile as it leaves the launcher is indicative of the position of the launcher. Alternatively, the same effect may be obtained when visible radiation is used if that visible radiation is appropriately shielded from the front of the barrel or bore of the launcher.

The selection of specific phosphors will depend in part upon the particular application intended. Thus, depending upon the application, there may be a different emphasis placed upon the phosphorescence commencing as soon as the projectile leaves the launcher, the phosphorescence continuing throughout the entire travel path of the projectile (and, depending upon the type of projectile and launcher, this may vary from several seconds to several minutes), and the phosphorescence continuing for a period of time after the projectile has struck a target or otherwise come to rest. Different phosphors will release their stored energy at different rates and with different colors. However, it is well within the skill of those in the phosphor art to select appropriate phosphors best suited for particular applications.

Having described the phosphor-containing projectiles 10 which may be launched, we turn now to the toy launcher, generally designated 50, for launching the same. The launcher 50 may be in the form of a rifle, handgun, mortar, cannon, game piece launcher, or the like without substantially affecting the functional elements thereof. The essential elements of the launcher 50 include means for launching a phosphor-containing projectile outwardly from the launcher and means for exposing the projectile within the launcher to phosphorescence activating radiation prior to the projectile leaving the launcher, so that the projectile will phosphoresce as it leaves the launcher.

Figure 7:
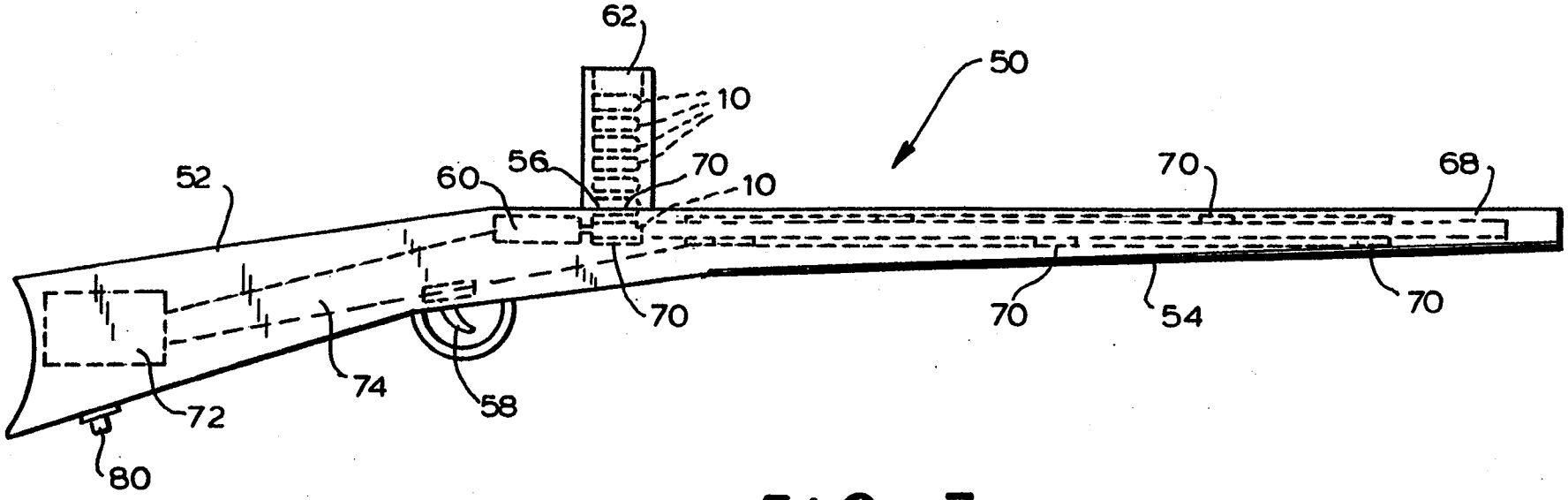
FIG. 7 is an isometric view of a first embodiment of a launcher according to the present invention for projectiles of the first through fifth embodiments.

Referring now to FIG. 7, therein illustrated is a launcher 50 in the form of a toy rifle generally designated **50*a*. The toy rifle 50*a* includes a stock 52 (which may be a handle in a handgun or a base in a cannon), a barrel 54 (which may be a bore in a cannon), and a breech 56 (more technically called "the action") therebetween for holding the projectile 10 prior to its being fired. Typically there is also a trigger or similar firing mechanism 58 which is actuated by the user in order to cause the projectile 10 to be launched. A propelling, propulsion or launching means 60 is disposed adjacent the breech 56 for actually launching the projectile 10 outwardly from the launcher 50*a*. The propelling means 60 may be any of a wide variety of conventional mechanisms for propelling a projectile from a launcher including air or carbon dioxide gas propulsion systems, tensioned elastic element propulsion systems, a pair of rotating wheels (which grasp the projectile therebetween and propel it forwardly), or the like. Accordingly, the propelling means 60 is illustrated only as a black box. In the embodiment illustrated, an optional magazine 62 contains a plurality of the projectiles 10 for insertion, one at a time, into the breech 56 either automatically or by a manual action cocking mechanism. In the absence of magazine 62, the projectiles 10 may be individually placed in the breech 56** prior to firing.

The rifle **50*a* illustrates two means for exposing the projectile 10 therewithin to phosphorescence-activating radiation prior to the projectile leaving the launcher. First, the barrel 54 defines a recess 68 containing a plurality of lighting elements 70 spaced axially and circumferentially about the inner surface of the barrel 54. (If the barrel 54 is transparent, the lighting elements 70 may be disposed about the outer surface of the barrel.) Second, at least one lighting element 70 (and, as illustrated, two diametrically opposed lighting elements 70) are disposed in or about the inner surface of the breech 56. Thus the lighting elements 70 in the breech 56 illuminate the projectile 10 prior to its being "fired" or launched from the breech 56, and the lighting elements 70 in the barrel 54 illuminate the projectile 10 after it is launched from the breech 56 but before it leaves the barrel 54. Typically a given rifle 50*a*** will contain only one of the two illustrated exposing means.

The lighting elements 70 may be energized by means of an external power source, but, for portability, a battery pack 72 is preferably disposed within a cavity in stock 52 and connected to the various lighting elements by means of leads 74. If desired, the battery pack 72 may be rechargeable and may also be used to power the propelling means 60.

The lighting elements 70 are selected to expose the projectile 10 to radiation of near ultraviolet to visible wavelengths, thereby to cause the projectile 10 to phosphoresce. In order to prevent detection of the radiation by an "opponent" through the front end of the barrel 54, the radiation may be selected to be invisible to human vision, provided it still phosphorescence-activating. Alternatively, the lighting elements 70 may be partially surrounded by reflectors or louvers which act to conceal the radiation from view through the front of the barrel 54 and focus it on the projectile.

The exposing means in the breech may be continually energized so that a projectile is exposed to the phosphorescence-activating radiation from the instant it is placed in the breech. However, as earlier noted, it is only necessary for the exposing means to expose the projectile to the activating radiation briefly, and preferably only immediately prior to the projectile leaving the launcher. Accordingly, the rifle may be provided with a manually operable switch 80 for actuating the exposing means—that is, connecting the battery pack 72 to the lighting elements 70. In a preferred embodiment the switch 80 in the "on" position only places the electrical connection between the battery pack 72 and the lighting elements 70 under control of the trigger mechanism 58. The trigger mechanism 58 may be a two stage trigger wherein the first half-pull of the trigger activates the exposing means and the second half-pull of the trigger activates the launching or propelling means 60. In this way, the drain of power from the battery pack 72 is minimized, and the possibility of detection of any visible radiation by an "opponent" is also minimized.

Depending upon the delay before the projectile will be launched once the launching or propelling means 60 is activated, a one-stage trigger may be used with the trigger actuating the launching means 60 and the exposing means 70 simultaneously or even the exposing means 70 prior to the launching means 60. Typically, it is desirable for the projectile 10 to be launched at the exact instant that the trigger is pulled, so that, depending upon the propelling means 60 utilized, there may not be time for adequate radiation of the projectile 10 in the breech 56 (about 1–2 seconds being preferred) after a trigger pull. In this instance, the positioning of the lighting elements 70 in the barrel 54 may, either alone or in combination with the lighting elements 70 in the breech 56, provide a suitable exposure time for the projectile 10 before it leaves the barrel 54. Clearly the provision of lighting elements 70 within the barrel 54 of a handgun (as opposed to a rifle) would only minimally extend the exposure time. It will be appreciated that the lighting elements 70 may be disposed in the breech 56, the barrel 54, or both, depending upon the intended application.

While in some instances a single lighting element 70 will suffice to provide the projectile 10 with adequate phosphorescence-activating radiation (especially where that phosphorescence is limited to a partial circumference of the outer coating of the projectile and the lighting element is provided with a suitable reflector), a greater number of lighting elements 70 (with or without reflectors) may be used as necessary to provide adequate phosphorescence-activating radiation to all phosphorescent surfaces within the limited time available.

Figure 8:
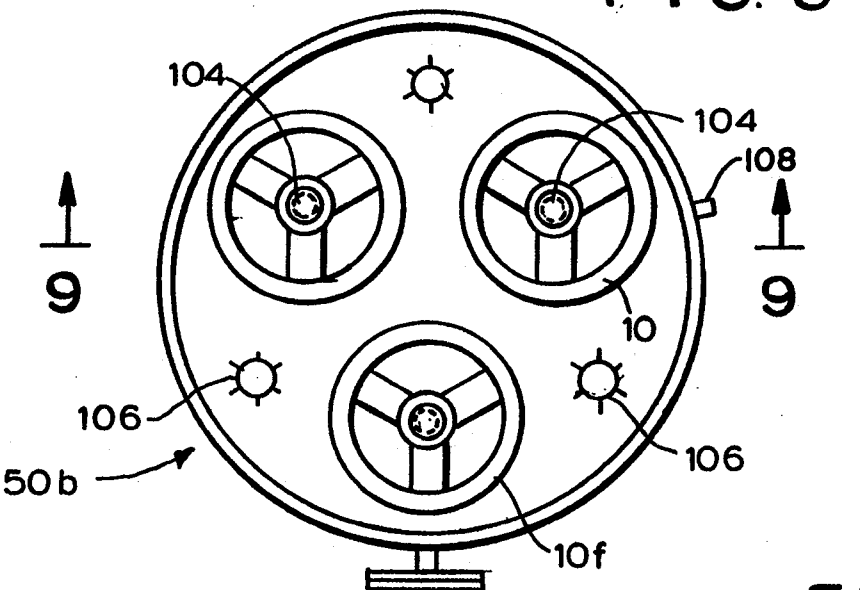
FIG. 8 is a top plan view of a second embodiment of a launcher for projectiles of the sixth embodiment, with the shutters removed.
Figure 9:
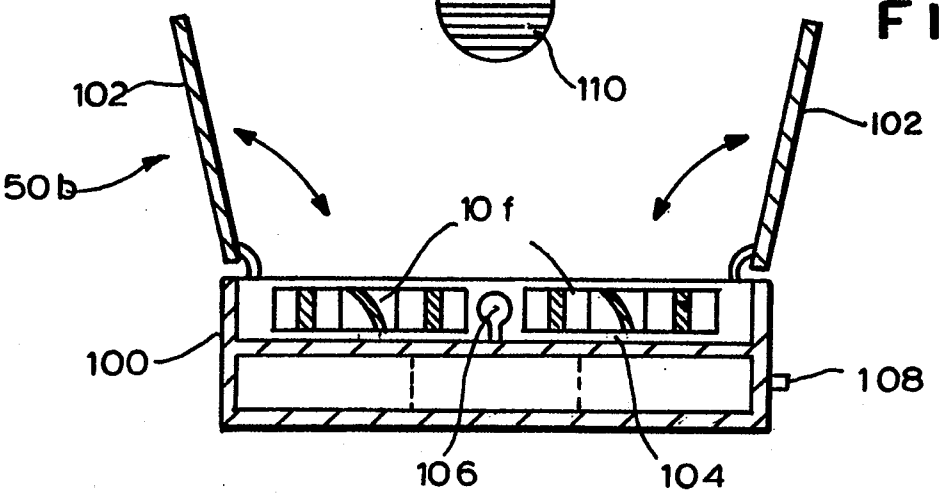
FIG. 9 is a sectional view thereof taken along the line 9—9 of FIG. 8.

Referring now to FIGS. 8 and 9, the launcher **50*b* for a helicopter disk projectile 10f comprises a cylindrical housing 100 having a pair of shutters 102 pivotally secured thereto and movable between a closed orientation (not shown) where they cover the top of the housing 100 and an open or launching orientation wherein they extend transverse to or outwardly from the housing 100 to expose the top thereof and permit the release of the disks 10*f* upwardly therefrom. The base of the housing 10 houses a battery pack (not shown), a motor, and a drive/release mechanism 104 which engages the disks 10*f* and, when actuated causes them to rotate rapidly, and then releases them. As illustrated, there are three equidistantly spaced disks 10F disposed on the upper surface of the housing 100, each being disposed on one of the drive/release mechanisms 104 extending above the top of the housing 100, and, three equidistantly spaced lighting elements 106 above the housing top, one intermediate each pair of disks 10*f*. The housing 100 is additionally provided with a first or "on/off" switch 108 and a second or foot pedal switch 110**.

In order to operate the launcher **50*b*, the on/off switch 108 is actuated, thereby causing the motor to start spinning of the drive/release mechanisms 104 (and hence the disks 10*f*) and to illuminate the lighting elements 106 (and hence expose the disks 10*f* to phosphorescence-activating radiation). As the shutters 102 are initially in the closed orientation, they block from view the light from lighting elements 106. (The on/off switch 108 thus acts as a cocking mechanism to activate the exposure means without actuating the launching means). Then, when the foot pedal switch 110 is actuated, the lighting elements 106 are turned off (so that the location of the launcher 50*b* is not disclosed thereby), the shutters 102 are pivoted to the open/launch orientation, the drive/release mechanisms 104 are retracted from the spinning disks 10*f* so that the disks then rise (due to the airfoil action created by their spinning), and the motor is de-activated. (The foot pedal switch 110 thus acts as a trigger mechanism to activate the launching means). The launcher 50*b* is subsequently re-initialized by replacing the disks 10*f* on the drive/release mechanisms 104 and moving the shutters 102** to the closed orientation thereover.

Figure 10:
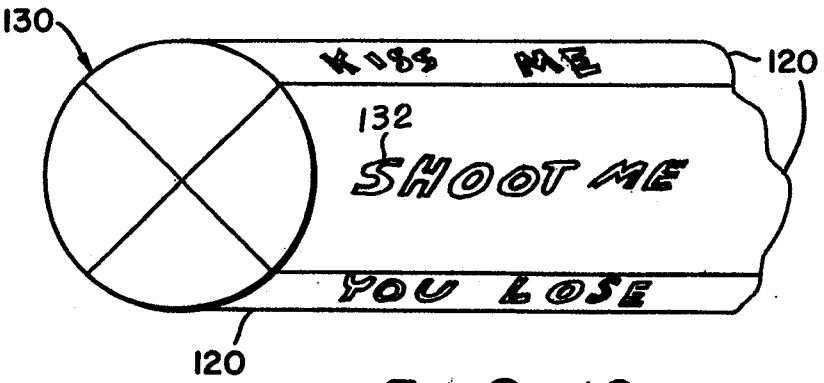
FIG. 10 is an isometric view, to a greatly enlarged scale, of an external mask.
Figure 11:
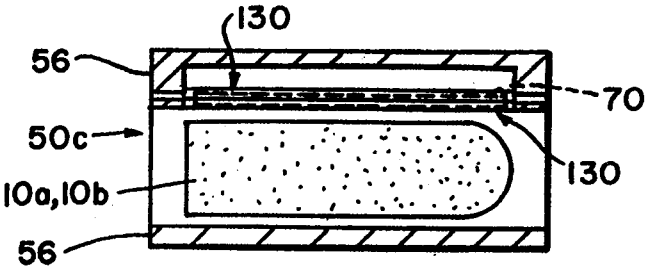
FIG. 11 is a sectional view of the breach of a third embodiment of a launcher using an external mask.

As illustrated in FIGS. 3 and 4, a design-defining pattern of phosphorescence may be created on a projectile **10*c*, 10*d* either by selectively applying the phosphor to the projectile (as a patterned surface coating) or by applying an opaque mask to the projectile. Referring now to FIGS. 10 and 11, a design-defining pattern of phosphoresence may be created on a projectile 10—without the phosphor itself being disposed in a pattern and without the mask being on the projectile itself—through the use of an "external" mask 120 disposed in a third embodiment of a launcher, generally designated 50*c*, intermediate the exposing means and the projectile. Only unmasked portions of the projectile (i.e., those portions aligned with radiation-transparent areas of the otherwise opaque mask) are exposed to the phosphoresence-activating radiation from the exposing means prior to the projectile leaving the launcher 50*c*. Thus the projectile 10 will phosphoresce as it leaves the launcher 50*c* in a pattern determined by the external mask 120**.

Preferably in such a launcher **50*c* the exposing means does not extend about the full peripheral surface area (e.g., circumference) of the projectile 10, but only about an arc or sector thereof. This enables the mask 120 to control the radiation passing from the exposing means to the pertinent sector of the projectile. The projectile itself may be of the first or second embodiments 10*a*, 10*b*—that is, either an opaque core 12 with a uniform phosphor-containing outer surface 14 or a uniformly phosphor-containing projectile 16. In the first projectile embodiment 10*a* it is not essential that the phosphor-containing surface coating 14 extend about the entire peripheral surface area of the core 12 so long as it extends about the sector of the peripheral surface area thereof which would receive radiation through the mask 120. However, as such a projectile would require insertion into the breach 56 in a predetermined orientation not easily achievable, especially under simulated dark battlefield conditions, typically the surface coating 14 will extend about the full peripheral surface area of the core 12**.

The launcher **50*c* may include a plurality of the masks 120, although only one mask 120 at a time is disposed intermediate the exposing means and the projectile. For example, there may be a plurality of masks 120 which are removably insertable into the breach 56, one at a time, in order to enable the player to vary the pattern of radiation to which the projectiles are exposed. Preferably, however, the plurality of masks is disposed on a wheel- or cylinder-like structure, generally designated 130, and the structure 130 is rotatable about either the projectile or exposing means in order to dispose different ones of the masks 120 intermediate the exposing means and the projectile. For example, a cylinder 130 may have four different masks 120, each extending over a 90° arc of its circumference. Each mask 120 defines a transparent portion 132** containing its own pattern or logo and reading, by way of example, "shoot me," "you lose," "kiss me," or the like.

Rotation of the cylinder 130 so as to bring a different mask 120 intermediate the exposing means and the projectile may be under the control of the player so that the player can select an appropriate message for a given projectile, or it may be random (i.e., not under control of the player) so that the player does not know what pattern a given projectile will carry. For example, each firing of a launcher may result in spinning of the cylinder 130 with chance determine which mask 120 is disposed between the exposing means and the projectile when the spinning stops. The cylinder 130 may either be fixedly (but rotatably) secured to the launcher 50*c* or it may be removably secured to the launcher 50*c* so that the projectile need not carrying any message from the cylinder. Indeed, in a preferred embodiment, of the several masks 120 on the cylinder 130, one is all transparent and another is all opaque, and the selection of these two extremes masks at least is under the control of the player who then has the options of firing a non-luminous projectile, a totally luminous projectile, or a projectile containing a luminous pattern determined by one of the other masks on the cylinder.

The cylinder 130 is preferably rotatable about the exposing means (e.g., lighting element 70), as illustrated in FIG. 10, so that it does not interfere with the passage of projectiles 10 from the magazine 62 into the breach 56 and its axis of rotation is spaced from the travel path of the projectile 10 launched from the breech 56. However in a structurally more complex embodiment of the breach 56 the cylinder 130 may be rotatable about the projectile 10.

To summarize, the present invention provides a system which enables luminous projectiles to be launched from a gun or other delivery system which renders the projectile brightly visible in flight and/or during game play, thus allowing for outdoor play at night and/or normal play in dark spaces. The projectile is luminous from the instant of launch from the launcher and typically for some time after the projectile flight is terminated. The projectiles may contain text or other stylized designs, which are rendered luminous either positively or negatively, may be non-rigid or flexible, and may be a luminous gel or fluid. A preferred embodiment of the system is safe for use by children.

Now that the preferred embodiments of the present various invention have been shown and described in detail, modifications and improvements thereon will become readily apparent to those skilled in the art. Accordingly, the spirit and scope of the present invention is to be construed broadly and limited only by the appended claims, and not by the foregoing specification.

We claim:

1. A toy launcher for a phosphor-containing projectile, comprising:

(A) means for launching a phosphor-containing projectile outwardly from said launcher; and (B) means for exposing the projectile within said launcher to phosphorescence-activating radiation prior to the projectile leaving said launcher;

whereby the projectile will phosphoresce as it leaves said launcher.

2. The launcher of claim 1 wherein said exposing means exposes the projectile to radiation of near UV to visible wavelengths, thereby to cause the projectile to phosphoresce.

3. The launcher of claim 1 wherein said radiation is not visible to human vision.

4. The launcher of claim 1 additionally including a breech and a barrel or bore, said launching means launching the projectile in said breech through said barrel or bore.

5. The launcher of claim 4 wherein said exposing means is disposed in said breech and exposes the projectile in said breech to said radiation.

6. The launcher of claim 4 wherein said exposing means is disposed in said barrel or bore and exposes the projectile to said radiation as the projectile passes through said barrel or bore.

7. The launcher of claim 1 including manually operable means for actuating said exposing means.

8. The launcher of claim 1 including manually operable means for actuating said launching means and said exposing means in timed relationship.

9. The launcher of claim 8 wherein said actuating means actuates said launching means and said exposing means simultaneously.

10. The launcher of claim 8 wherein said actuating means actuates said exposing means prior to said launching means.

11. The launcher of claim 1 additionally including a magazine configured and dimensioned to hold a plurality of projectiles, and means to feed the projectiles serially to said launching means, said actuating means actuating said feed means and said exposing means.

12. The launcher of claim 1 wherein said exposing means exposes the projectile to said radiation only immediately prior to the projectile leaving said launcher.

13. The launcher of claim 12 wherein said exposing means exposes the projectile to said radiation only briefly.

14. The launcher of claim 1 wherein said exposing means exposes the projectile to said radiation only briefly.

15. The launcher of claim 1 additionally including manually actuatable means for cocking said launching means, said cocking means also actuating said exposing means.

16. A toy launcher for a phosphor-containing projectile, comprising:

(A) means for launching a phosphor-containing projectile outwardly from said launcher;

(B) means for exposing the projectile within said launcher to phosphorescence-activating radiation of near UV to visible wavelengths prior to the projectile leaving said launcher, said exposing means exposing the projectile to said radiation only briefly prior to the projectile leaving said launcher;

(C) a breech and a barrel or bore, said exposing means exposing the projectile in said breech to said radiation, and said launching means launching the projectile in said breech through said barrel or bore; and (D) manually operable means for actuating said exposing means and said launching means;

whereby the projectile will phosphoresce as it leaves said launcher.

17. A phosphor-containing projectile for launching from a toy launcher in a phosphorescent state after exposure to phosphorescence-activating radiation by the launcher, said projectile comprising:

(A) foamed plastic core; and (B) a phosphor-containing surface coating.

18. A phosphor-containing projectile for launching from a toy launcher in a phosphorescent state after exposure to phosphorescence-activating radiation by the launcher, said projectile comprising:

(A) an opaque core; and (B) a design-defining pattern of a phosphor-containing surface coating.

19. A phosphor-containing projectile for launching from a toy launcher in a phosphorescent state after exposure to phosphorescence-activating radiation by the launcher, said projectile comprising:

(A) a phosphor-containing core; and (B) a design-defining pattern of an opaque surface coating.

20. A phosphor-containing projectile for launching from a toy launcher in a phosphorescent state after exposure to phosphorescence-activating radiation by the launcher, said projectile comprising:

(A) a core containing a first phosphor; and (B) a design-defining pattern of a surface coating containing a second phosphor;

said first and second phosphors having phosphorescence of different colors such that the phosphorescence color of one phosphor is visible against the phosphorescence color of the other phosphor.

21. In combination, a toy launcher and a phosphor-containing projectile, said launcher comprising:

(A) means for launching said phosphor-containing projectile outwardly from said launcher; and (B) means for exposing said projectile within said launcher to phosphoescence-activating radiation prior to said projectile leaving said launcher;

whereby said projectile will phosphoresce as it leave said launcher.

22. The combination of claim 21 additionally including mask means disposed intermediate said exposing means and said projectile such that said mask means enables passage of said phosphorescent-activating radiation from said exposing means to said projectile only in a design-defining pattern, whereby only potions of said projectile are exposed to said phosporescence-activating radiation prior to said projectile leaving said launcher, and said projectile will phosphoresce as it leaves said launcher in a design determined by said mask means.

23. The combination of claim 21 including a plurality of said mask means, only one of said mask means at a time being disposed intermediate said exposing means and said projectile.

24. The combination of claim 23 wherein said plurality of mask means are disposed on a cylinder-like structure, and said structure is rotatable to dispose at a given time a selected one of said plurality of mask means intermediate said exposing means and said projectile.

25. The combination of claim 22 wherein said projectile has, on at least an outer surface of at least a sector thereof, a uniform phosphor level, and said exposing means exposes said outer surface of said sector of said projectile selectively through said mask means to said phosphorescence-activating radiation.

26. The combination of claim 22 wherein said mask means is removable from the remainder of said launcher.

* * * * *